US010334923B2

(12) United States Patent
Tatham

(10) Patent No.: US 10,334,923 B2
(45) Date of Patent: Jul. 2, 2019

(54) CARRIER APPARATUS FOR GARMENTS

(71) Applicant: FirstLight Projects London Limited, London (GB)

(72) Inventor: Patrick Tatham, London (GB)

(73) Assignee: FirstLight Projects London Limited, London (GB)

( * ) Notice: Subject to any disclaimer, the term of this patent is extended or adjusted under 35 U.S.C. 154(b) by 93 days.

(21) Appl. No.: 15/309,330

(22) PCT Filed: May 8, 2015

(86) PCT No.: PCT/GB2015/051353
§ 371 (c)(1),
(2) Date: Nov. 7, 2016

(87) PCT Pub. No.: WO2015/170109
PCT Pub. Date: Nov. 12, 2015

(65) Prior Publication Data

US 2017/0071301 A1 Mar. 16, 2017

(30) Foreign Application Priority Data

May 8, 2014 (GB) ..... 1408151.7

(51) Int. Cl.

| | |
|---|---|
| ***A47G 25/14*** | (2006.01) |
| ***A45C 3/00*** | (2006.01) |
| ***A47G 25/40*** | (2006.01) |
| ***A45C 13/03*** | (2006.01) |
| ***A45C 13/10*** | (2006.01) |
| ***A47G 25/48*** | (2006.01) |

(52) U.S. Cl.
CPC ..... *A45C 3/004* (2013.01); *A45C 13/03* (2013.01); *A45C 13/1069* (2013.01); *A47G 25/4038* (2013.01); *A47G 25/48* (2013.01)

(58) Field of Classification Search
CPC ..... B65D 85/185; B65D 85/18; A45C 3/004; A45C 13/03; A47G 25/54
USPC ..... 206/279, 278; 223/89, 94, 61
See application file for complete search history.

(56) References Cited

U.S. PATENT DOCUMENTS

| | | | | |
|---|---|---|---|---|
| 4,300,688 A * | 11/1981 | London | A47G 25/36 | 206/285 |
| 4,869,408 A | 9/1989 | Lutz | | |
| 6,026,998 A * | 2/2000 | Brooks | A47G 25/20 | 223/89 |
| 6,293,443 B1 | 9/2001 | Nykoluk | | |
| 6,427,882 B1 * | 8/2002 | Harvey | A47G 25/4023 | 223/85 |
| 6,431,418 B1 * | 8/2002 | Pease | A45C 3/004 | 223/61 |

(Continued)

FOREIGN PATENT DOCUMENTS

GB 191207351 A 7/1912

*Primary Examiner* — Fenn C Mathew
*Assistant Examiner* — Cynthia F Collado
(74) *Attorney, Agent, or Firm* — Young Basile Hanlon & MacFarlane, P.C.

(57) ABSTRACT

A carrier apparatus for supporting a garment includes a hanger having first and second arm elements that project radially outwardly from a central hanging axis and which are connected by a hinged coupling which allows the first and second arm elements to be folded around said central axis or axes parallel to said central hanging axis to thereby substantially overlie one another.

19 Claims, 8 Drawing Sheets

(56) References Cited

U.S. PATENT DOCUMENTS

| | | | | |
|---|---|---|---|---|
| 6,675,997 | B1 * | 1/2004 | Gouldson | A47G 25/18 223/89 |
| D508,614 | S * | 8/2005 | Colon | D6/318 |
| 7,185,795 | B1 * | 3/2007 | Wallick | A47G 25/08 223/89 |
| 7,237,702 | B2 * | 7/2007 | Landis | A47G 25/4023 223/89 |
| 7,784,654 | B1 * | 8/2010 | Mercado | A47G 25/4038 223/89 |
| 9,113,736 | B1 * | 8/2015 | Antler | A47G 25/32 |
| 9,687,099 | B2 * | 6/2017 | Snow | A47G 25/4038 |
| 9,801,485 | B2 * | 10/2017 | Snow | A47G 25/4038 |
| 9,924,818 | B2 * | 3/2018 | Amen Rodriguez | A47G 25/32 |
| 2004/0211797 | A1 | 10/2004 | Landis et al. | |

* cited by examiner

CARRIER APPARATUS FOR GARMENTS

CROSS REFERENCE TO RELATED APPLICATION

The present application claims priority to Great Britain Patent Application No. 1408151.7, filed May 8, 2014, incorporated herein in its entirety.

TECHNICAL FIELD

The present invention relates to carrier apparatus for transporting garments, and particularly to such carrier apparatus for transporting garments in a folded state.

BACKGROUND

In this connection, various garment carriers, for example suit carriers, are known where the garment is placed on a hanger and then introduced into a carrier. The carrier is then folded about its middle such that the garment itself is folded about its mid-section within the carrier.

Despite being folded about their middle, such known carriers can remain relatively large, to the extent that they are not practical to carry, for example, as cabin luggage or in a bicycle pannier.

Furthermore, such known garment carriers do not, by the nature of their folding, offer an ideal environment for the garment they are transporting, whereby creasing is inevitable.

SUMMARY

The present invention seeks to provide a garment carrier that alleviates the problems associated with known arrangements.

According to a first aspect of the present invention there is provided carrier apparatus for a garment, the apparatus comprising a hanger having first and second arm elements that project radially outwardly from a central hanging axis and which are connected by a hinged coupling which allows the first and second arm elements to be folded around said central axis or axes parallel to said central hanging axis to thereby overlie one another. Such an arrangement provides for a carrier apparatus that can be folded effectively with a garment in place.

Preferably, the first and second arm elements have an unfolded state in which the first and second arm elements lie in substantially the same plane, the first and second arm elements being deployed into the folded state by folding one or more of said arm elements out of said plane so that they come together.

Conveniently, the hanger is configured to be folded while holding a garment.

Preferably, the first and second arm elements are provided with respective fastenings for holding them in an overlying condition. Conveniently, the fastenings are magnetic fastenings. The fastenings are preferably removably mounted on the arm elements.

The hinged coupling may comprise a double hinge mechanism, where two separate hinges are provided, spaced by a connecting element. In this way, the hinged coupling creates a space or void in the region of the hinged coupling for accommodating the garment in the folding region.

Conveniently, in a folded state of the hanger, the hinged coupling has a substantially "U" shaped configuration.

Conveniently, the hinged coupling has means for locking the first and second arms in an unfolded configuration, so that they are fixed in substantially the same plane. Conveniently, "snap" locks may be provided that hold the arms in their folded configuration.

The hinged coupling may comprise a strip of resilient material connected to ends of the first and second arm elements. The material may be semi-rigid or rigid and may have a memory biasing it to a desired configuration.

Conveniently, each hinge of the hinged coupling comprises a catch mechanism for locking the angular position of its arm element in position relative to the connecting element.

The hinged coupling is preferably between 3 cm and 7 cm in length and more preferably 3 cm. In this connection, the distance between hinge axes is conveniently 1-2 cm, and more preferably 1.6 cm, thereby creating a void of 1 cm.

Each arm element may comprise upper and lower limbs in a substantially "v" shaped configuration. The upper limb is inclined with regard to the lower limb to conform to the general shape of a human shoulder blade.

Conveniently, a first hinged coupling connects respective ends of the upper limbs and a second hinged coupling connects respective ends of the lower limbs. The first and second hinged couplings as such provide upper and lower connections for the hanger.

Preferably, said fastening means are provided at the apex of the upper and lower limbs of each arm element.

Preferably, the upper facing surfaces of the first and second arm elements are provided with an anti-slip surface.

Conveniently, the hinged coupling may comprise a 'snap' locking mechanism that affords the arm elements with rigidity when in an unfolded open position, and which holds the arm elements locked when folded. Preferably, the application of relatively gentle pressure will result in the arm elements 'snapping' unlocked to change the configuration of the arm elements between open or unfolded and closed or folded configurations.

Preferably, the hanger further comprises one or more fastenings for fastening the hanger within a garment storage bag.

Conveniently, the carrier apparatus further comprises a garment storage bag to which the hanger is couplable, wherein the storage bag is configured to fold about at least first and second axes, the first and second axes being substantial normal to one another.

Preferably, the garment storage bag is configured to fold about a third axis, the third axis being substantially parallel to the second axis. In this regard, the garment storage bag is foldable on two horizontal axes and then a vertical axis.

The garment storage bag may have one or more fastenings that couple to fastenings provided to said hanger such that the central axis of the hanger aligns with one of said first and second fold axes of the garment storage bag.

Preferably, the garment storage bag has a top zone, a central zone and a bottom zone, the three zones being defined by horizontal fold axes.

Conveniently, the central zone comprises one or more straps for retaining trousers. A pair of such straps are preferably provided, extending parallel to the hanging axis of the hanger.

The garment storage bag preferably has one or more connectors that couple to fastenings provided to said hanger such that the central hanging axis of the hanger aligns with one of said first and second fold axes of the garment storage bag.

Preferably the connectors and/or fastenings are snap fastenings.

According to a further aspect of the present invention there is provided a hanger for holding garments comprising: a pair of arm elements pivotally attached to respective ends of a connecting element, the arm elements and connecting element having respective inter-engaging catch elements for holding the arm elements at different angular positions with respect to the connecting element.

Preferably, the arm elements pivot about axes that are parallel to a hanging axis of the hanger.

Conveniently, the pivot axes of the arm elements are spaced between 1 and 2 cm apart by virtue of the connecting element to thereby create a void when the arms are folded to overlie one another. Preferably, the pivot axes are 1.6 cm apart.

DETAILED DESCRIPTION OF THE DRAWINGS

Embodiments of the invention will now be described by way of example and with reference to the accompanying drawings, of which:

Figure 6A:
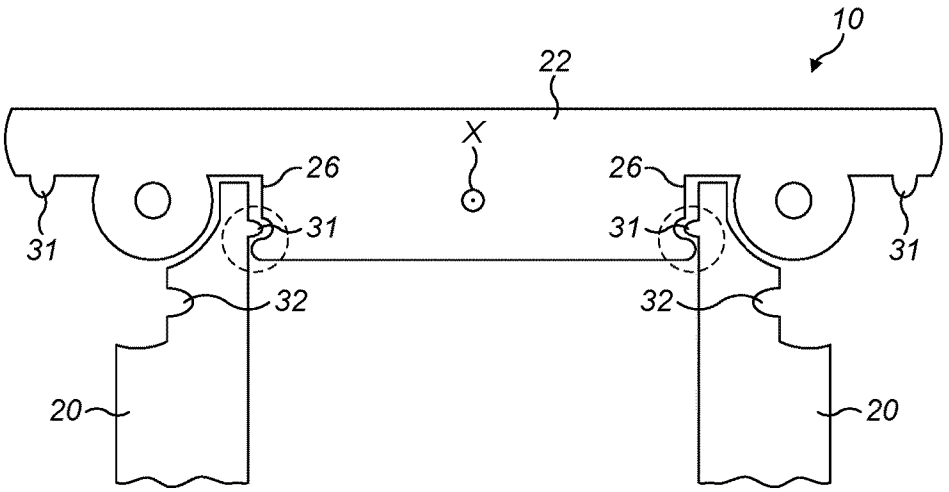
Figure 6B:
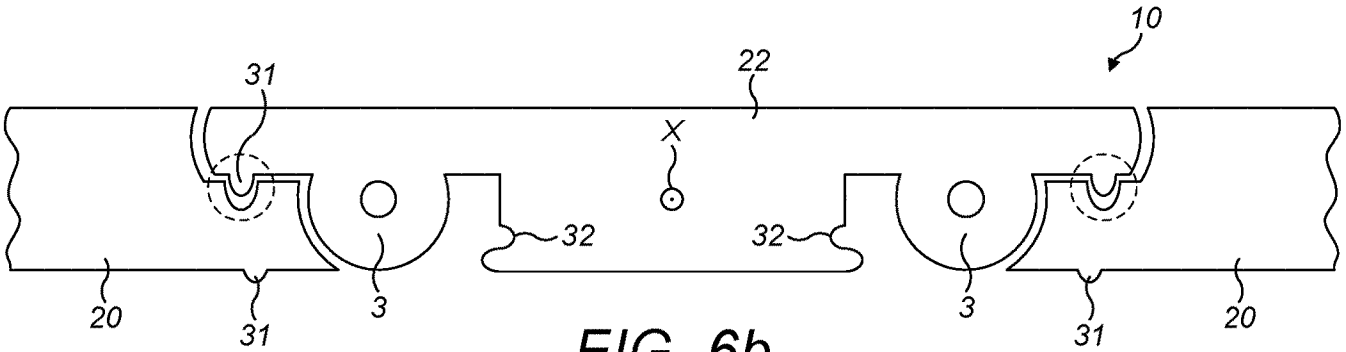
Figure 7A:
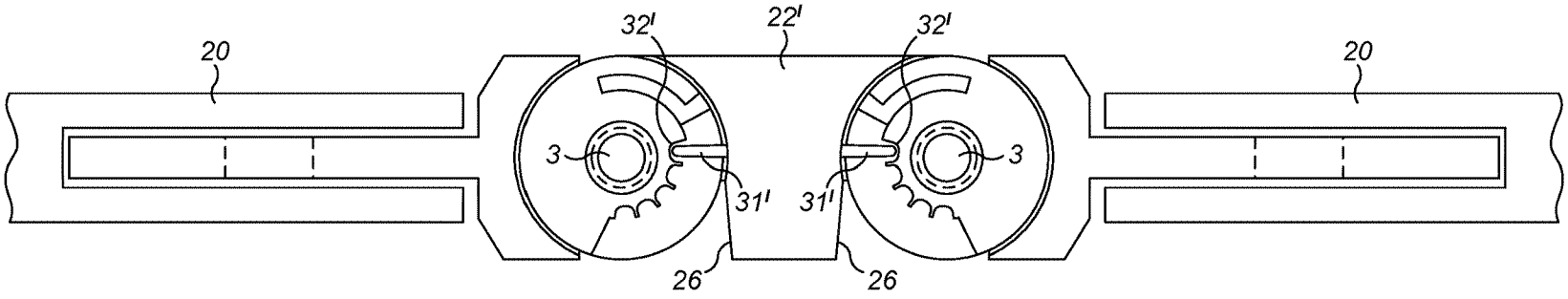
Figure 7C:
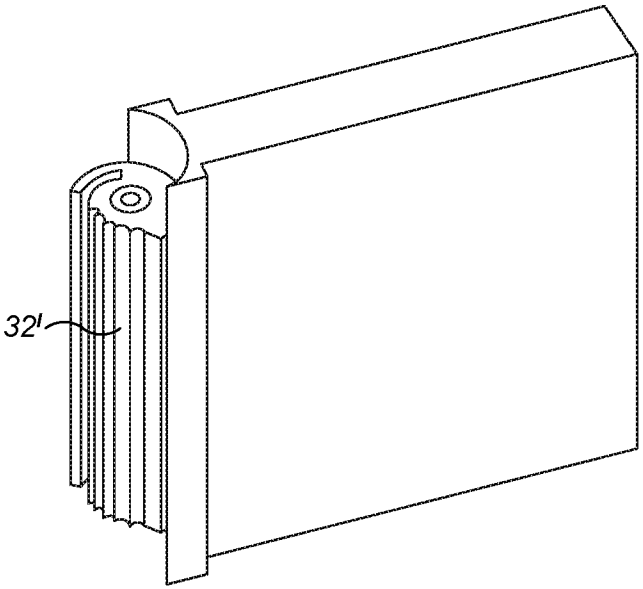
Figure 7B:
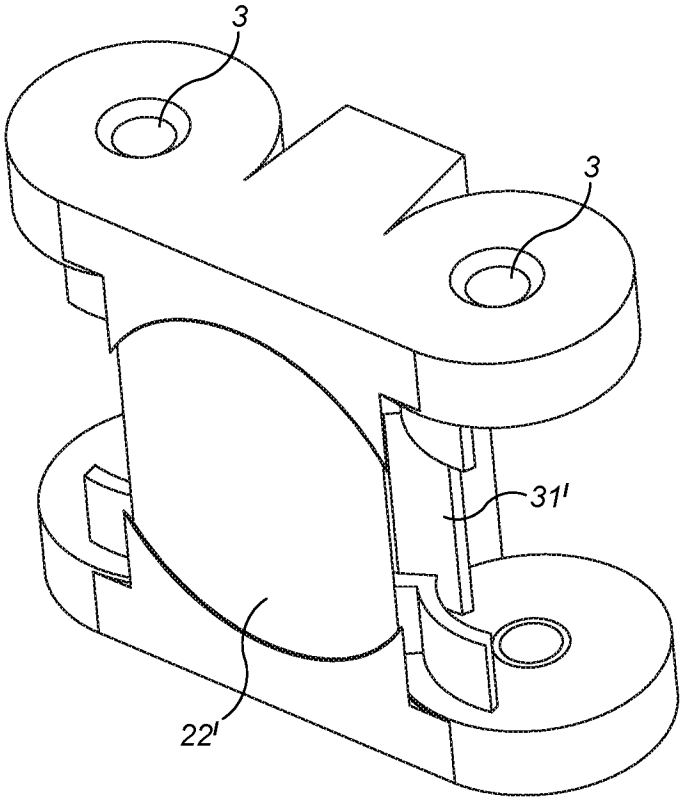

FIGS. 6*a* and 6*b* show views of a locking mechanism of the present invention, with FIG. 6*a* being a folded configuration and FIG. 6*b* being an unfolded configuration; and FIGS. 7*a*, 7*b* and 7*c* show an alternative locking mechanism of the present invention.

DETAILED DESCRIPTION OF THE EMBODIMENTS

Figure 1:
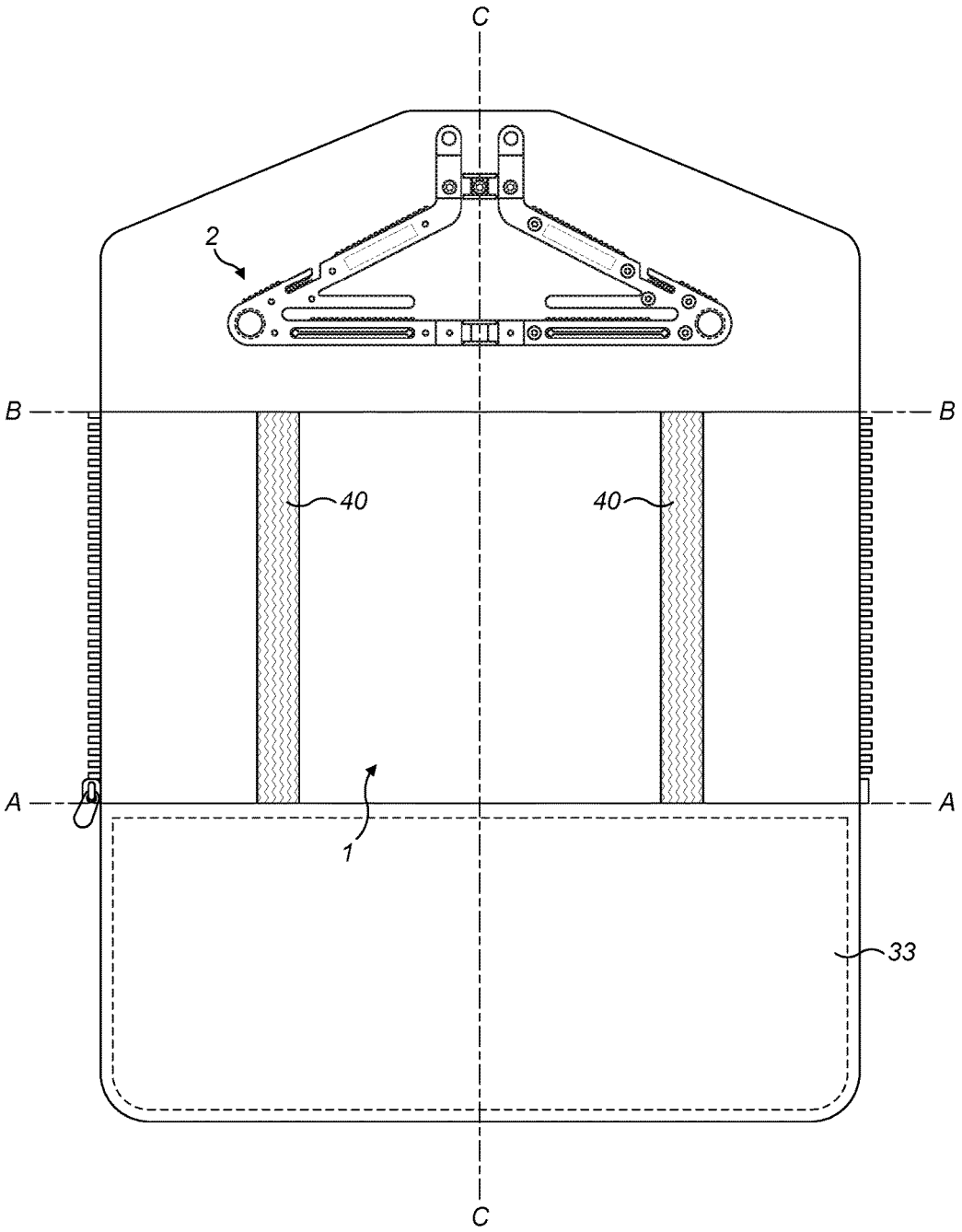
FIG. 1 shows carrier apparatus of the present invention.
Figure 2:
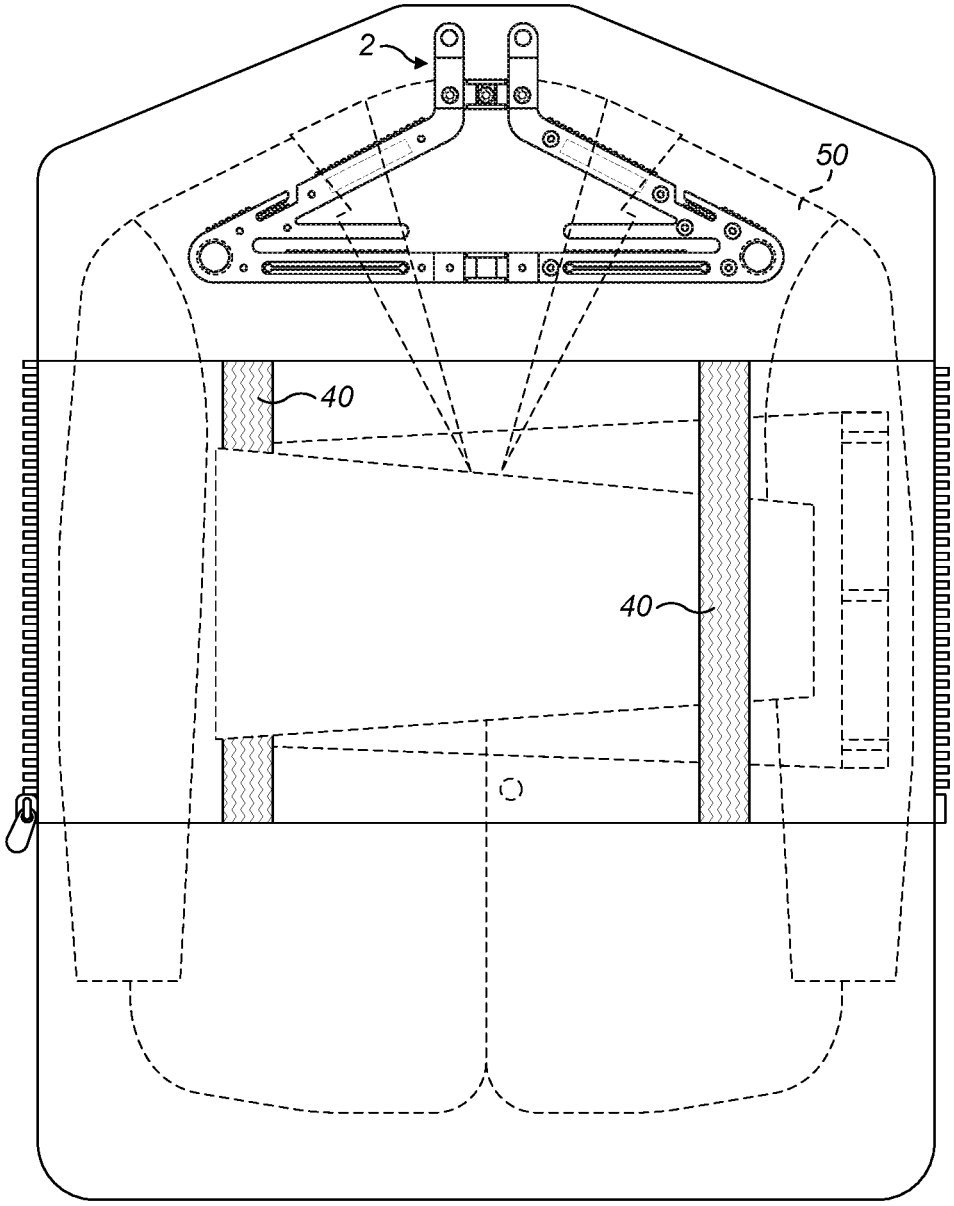
FIG. 2 shows the carrier apparatus of FIG. 1 with a jacket and trousers held within the apparatus.
Figure 3:
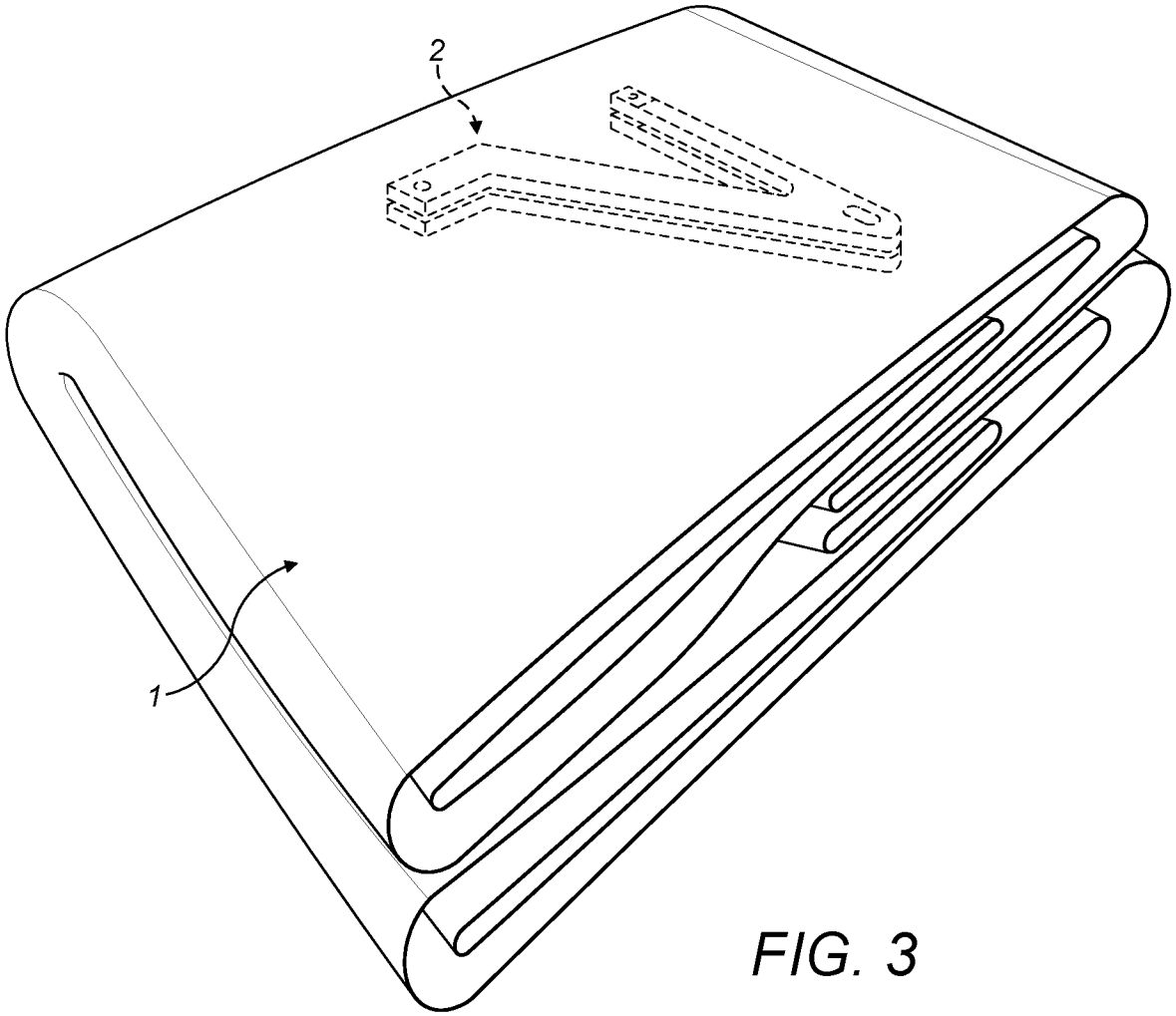
FIG. 3 shows the carrier apparatus of FIG. 1 in a folded state.

FIG. 1 shows a garment holder 1 that folds on three axes A-A, B-B and C-C, in other words, into sixths, to form a compact bag as shown in FIG. 3, approximately 45 cm×35 cm×6 cm. This in turn can be fitted into a range of purpose-designed larger travel goods (e.g. a wheelie bag, rucksack, messenger back or cycle pannier). In FIGS. 1 to 3, a folding hanger 2 in accordance with the invention, is shown in phantom lines.

As illustrated in FIGS. 4 to 7, the arms 20 of the coat hanger 2 each fold about a pair of double hinges 3, and form a triangular shaped article that fits precisely into the garment holder, securing the garments therein and preventing them from undue creasing or damage.

In this connection, the hanger has a central hanging axis X, namely the axis through which the weight a garment will be directed when the hanger is hung up. The hanger has, in this respect, a connecting element 22 that creates a "U" shaped space or void between its swinging arms to avoid compression and creasing of garments; while the locks maintain rigidity while the hanger is in its open position.

As will be seen, each of the double hinges 3 is configured such that its axis is parallel or substantially parallel to that of the central hanging axis X. The space 30 is created between the folded arms 20 and a connecting element 22 of the hinge couplings.

Removable magnets 4 may be provided in suitable recesses in the hanger arms 20 to keep the hanger 2 in the folded state, to secure the garments to the bag-shell, and to hold parts of the bag shell 1.

Furthermore, snap-button fixings 5 can be provided to secure the hanger to the bag.

Notched rubber strips 6 can also be integrated into some edges of the hanger to prevent garments from slipping.

The combination of garment bag and hanger of the present invention allows effective storage and transportation of articles of clothing—such as suits, shirts and dresses with as little creasing as possible.

The components may be designed for shorter journeys, rather than long-haul journeys. They should meet the majority of airlines' guidelines for 'carry-on' luggage. In this connection, while many flag-carriers airlines currently suggest a maximum carry-on dimensions of 56 cm×45 cm×20 cm, low-cost airlines are attempting to manage customers down to a limit of 50 cm×40 cm×20 cm.

The present invention encompasses a system for holding the folding hanger in the shell of the bag; and a range of garments securely to the hanger (and within the bag shell) while they are stored in the module. The system may comprise some or all of the following elements:

- Between four and six strong (removable) magnets 4 to secure the hanger 2 and the garments to the bag-shell, and to hold parts of the bag-shell 1 together, improving rigidity;
- Snap-button fixings 5 to secure the hanger to the bag;
- Notched rubber strips 6 integrated into some edges of the hanger to prevent garments from slipping; and
- A retaining flap or cover 33 to hold garments in place while folding the bag (and to provide a small amount of additional storage);

Because the carrier will inevitably be used in conjunction with items sensitive to electromagnetic radiation—for example: laptops, tablets and mobile phones—the magnetic fastenings in both the hanger and the bag-shell may have to be removable to avoid damaging the electronics nearby.

As shown in FIGS. 6*a* and 6*b* a snap-locking mechanism may be used to provide the hanger with as a high as possible a degree of rigidity while in its 'open' position of FIG. 6*b* so it can be fitted with garments; yet also gently to 'snap' closed as shown in FIG. 6*a* when the shell of the bag is closed around it. The hanger arms are arranged to 'snap' between the unfolded and folded configurations under the application of gentle pressure. In this regard, the locking mechanism includes a catch or detent means formed of locking protrusions 31 that engage with notches 32 provided respectively to the arms 20 and connecting element 22. The connecting element 22 is configured to have one or more abutment surfaces 26 that position the arms substantially at 90 degrees which the hanger is in its folded configuration.

FIGS. 7*a*, 7*b* and 7*c* show an alternative locking mechanism where the connecting element 22' comprises a hinge block having protrusions 31' which interengage with a splined part cylinders 32'. The splined part-cylinders 32' are coupled to the arms 20 of the hanger and are configured to be rotationally housed with respect to the hinge block. The protrusions 31' positively engage in the recessed grooves of the spline thereby allowing the arms of the hanger to be held at different rotational orientations.

In use, a jacket 50 is hung on the hanger which is in its deployed or unfolded configuration. The jacket is then slipped into the bag shell 1 as shown in FIG. 2. A pair of trousers may be secured in a central zone of the bag by way of straps or webs 40. The straps 40 extend parallel to the hanging axis of the hanger, such that they are substantially vertically aligned when the bag is hung up.

The bag is then folded about horizontal axes A-A and B-B, such that top and bottom zones are folded over onto the central zone The bag is then folded about the vertical axis C-C so that it is around a sixth of its original size. The bag may in this regard be folded so that its external dimensions are around 44 cm×32 cm×6 cm. The usable area for a suit within the bag is around 100 cm×68 cm.

The main folding hanger 2 is designed with the broad dimensions of existing hangers used typically for suits (trousers and jacket). A dress/camisole cut-out 7 can be provided in the upper part of the hanger arms.

In addition, many travellers will require a shirt/blouse or two, when on the move. To manage this, a second lighter hanger (not shown) with slightly different dimensions sits—or 'piggy-backs'—on the main hanger, secured using snap-buttons 25. Because this second hanger is slightly larger and more flexible, it folds neatly with any garments around the garments on the main hanger.

Further, the arms of both hangers can include 'cut-outs' 21—lined with neoprene or similar—for securing smaller items of clothing such as ties, belts and scarves.

Figure 4:
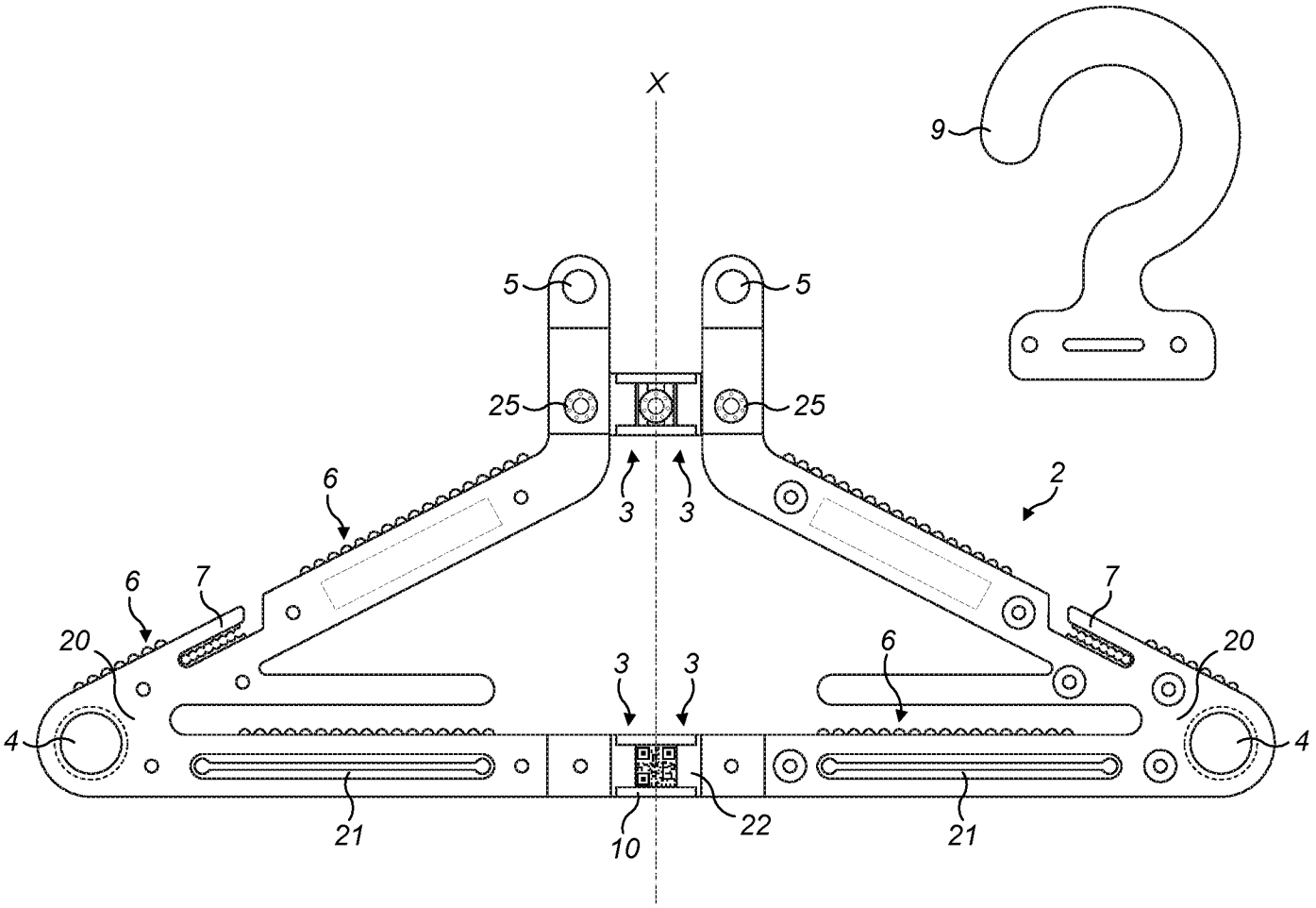
FIG. 4 shows a hanger of the present invention.
Figure 5:
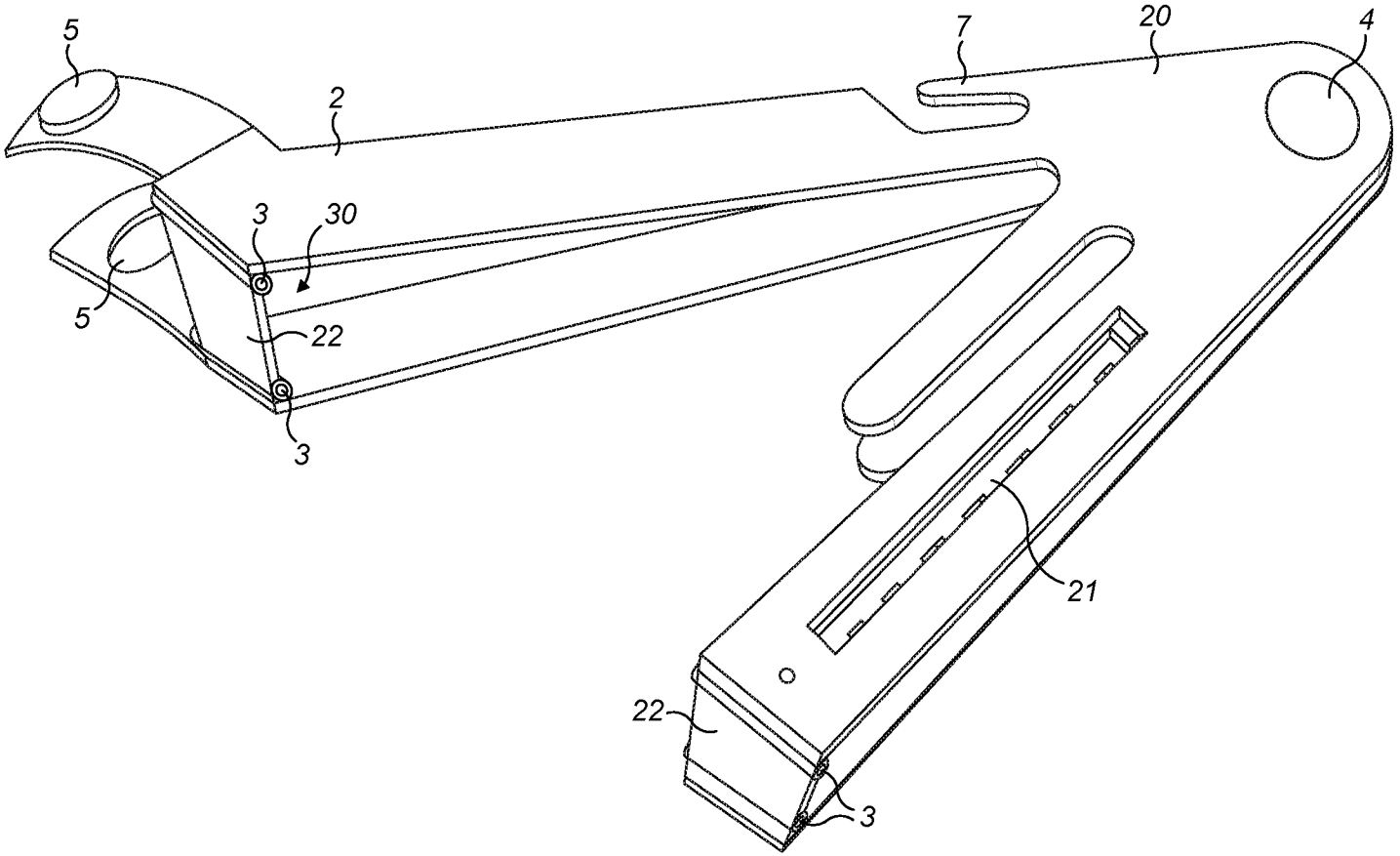
FIG. 5 shows the hanger of FIG. 4 in a folded configuration.

The multipoint fixing systems provides a comprehensive solution to holding garments securely while they are in the bag-shell. However, travellers arriving at their final destination will in all probability need to hang their garments conventionally in a wardrobe. To achieve this, the hanger may be bundled with an integral rotating strap that uses snap-button closures to allow the folding hanger to be hung upright on a clothes rail or hook. Alternatively, the apparatus may include a dual-purpose hanger 9 as shown in FIG. 4, allowing both the whole bag, and the garments only to be hung on a rail in a conventional manner.

While the bag-shell appears quite 'flat' when open—approximately 3 cm in height with a lightweight suit inside—as it folds, the bulk increases, particularly around the fold lines. To prevent garments being overly creased when the bag is folded, and to maintain the overall shape of the bag, it is designed with 'nesting' folds. The fold lines are measured and sewn such that as the bag folds, each section folds neatly (or nests) into the section below it.

Because the complete set of magnets (four in the bag-shell and two in the hanger) can be removed when using the module in close proximity to sensitive electronic items, provision is made to remove, store and identify the polarity of, the magnets. When removed, the magnets may be stored in a folding luggage label device that references the distinctive six-part folding design of the bag-shell—in short, that folds into sixths. The storage of the magnets will also provide a simple 'clasp' effect—holding the folding luggage label closed. It also features transparent plastic casing so the polarity of the magnets (which are marked positive and negative) is easy to determine when replacing them in the hanger and bag.

Identifying QR codes 10 may be provided on the hanger and the bag itself (for example on the luggage label) identifying key product features (serial number, date of manufacture, and model).

The hanger may be constructed using injection-moulded Acrylonitrile Butadiene Styrene (ABS) or a similar plastic, comprising four parts in total (two snapping together to form each arm. The integral ridges along the edges of the hanger to hold garments in place may be made of neoprene, or similar materials. Metal snap-buttons can hold the hanger to the bag shell, while metal or plastic rivets may secure the hanger's components.

The hangers may alternatively be made of other plastics, aluminium, wood and even top-leather (very heavy leather used in saddlery).

The bag-shell can be manufactured in both natural and manmade fibres, possibly with bespoke linings commissioned specifically from fabric designers.

The hanger may be formed in eye-catching shapes to make its appearance more distinctive and less easy to imitate; and more practically, to reduce weight and cost.

The garment carrier of the present invention is provided in the form of a folding module, potentially together with a range of larger bags, and provides not just a better method of packing garments, but a complete 'solution' for travellers of many sorts namely, short-haul travellers, leisure travellers, cyclists, adventure travellers.

The invention claimed is:

1. A carrier apparatus for supporting a garment, the apparatus comprising a hanger having first and second arm elements that project radially outwardly from a central hanging axis and which are connected by a hinged coupling which allows the first and second arm elements to be folded around said central axis or axes parallel to said central hanging axis to thereby substantially overlie one another, and a garment storage bag to which the hanger is couplable, wherein the garment storage bag is configured to fold at least first and second axes, the first and second axes being substantially normal to one another, and wherein the central axis of the hanger coincides with one of said first and second fold axes of the garment storage bag, wherein the garment storage bag has one or more fastenings that couple to fastenings provided to said hanger such that the central axis of the hanger coincides with one of said first and second fold axes of the garment storage bag.

2. The carrier apparatus according to claim 1, wherein the first and second arm elements have an unfolded state in which the first and second arm elements lie in substantially the same plane, the first and second arm elements being deployable into the folded state by folding one or more of said arm elements out of said plane so that they come together.

3. The carrier apparatus according to claim 1, wherein the hanger is configured to be folded while holding a garment.

4. The carrier apparatus according claim 1, wherein the first and second arm elements are provided with respective fastenings for holding them in an overlying condition.

5. The carrier apparatus according to claim 4, wherein the fastenings are magnetic fastenings.

6. The carrier apparatus according to claim 5, wherein the fastenings are removably mounted on the first and second arm elements.

7. The carrier apparatus according to claim 1, wherein the hinged coupling between the first and second arm elements creates a space between the first and second arm elements at or adjacent the hinged coupling when the hanger is in a folded configuration.

8. The carrier apparatus according to claim 1, wherein in a folded state of the hanger, the hinged coupling has a substantially "U" shaped configuration.

9. The carrier apparatus according to claim 1, wherein the hinged coupling has a 'snap' locking mechanism for locking the first and second arm elements in folded and unfolded configurations.

10. The carrier apparatus according to claim 1, wherein the hinged coupling comprises a double hinge mechanism, a connecting element being provided between each hinge of the double hinge mechanism.

11. The carrier apparatus according to claim 1, wherein each hinge of the hinged coupling comprises a catch mechanism for locking the angular position of its arm in position relative to the connecting element.

12. The carrier apparatus according to claim 1, wherein the hinged coupling is between 2 cm and 4 cm in length.

13. The carrier apparatus according to claim 1 wherein each arm element comprises upper and lower limbs in a substantially "v" shaped configuration.

14. The carrier apparatus according to claim 13, wherein a first hinged coupling connects respective ends of the upper limbs and a second hinged coupling connects respective ends of the lower limbs.

15. The carrier apparatus according to claim 13, wherein said fastening means are provided at the apex of the upper and lower limbs of each arm element.

16. The carrier apparatus according to claim 13, wherein the upper facing surfaces of the first and second arm elements are provided with an anti-slip surface.

17. The carrier apparatus according to claim 1, wherein the garment storage bag is configured to fold about a third axis, the third axis being substantially parallel to the second axis.

18. The carrier apparatus according to claim 17, wherein the garment storage bag has a top zone, a central zone and a bottom zone, the three zones being defined by horizontal fold axes.

19. The carrier apparatus according to claim 18, wherein the central zone comprises one or more vertical straps for retaining trousers.

* * * * *